United States Patent [19]

Kurz

[11] Patent Number: 4,876,754

[45] Date of Patent: Oct. 31, 1989

[54] BATHTUB SILENCER AND OVERFLOW PROTECTOR

[76] Inventor: Miklos G. Kurz, 300 Winston Dr., Cliffside Park, N.J. 07010

[21] Appl. No.: 146,822

[22] Filed: Jan. 22, 1988

[51] Int. Cl.[4] ..... A47K 3/00

[52] U.S. Cl. ..... 4/546; 4/661; 4/559; 4/198; 4/206

[58] Field of Search ..... 4/661, 255, 538, 609, 4/559, , 584, 597, 612, 605, 191, 198, 201, 206, 658, DIG. 5; 137/313, 314, 562; 239/499, 504, 505, 524, 24, 37, 38; 141/331, 333, 339, 343, 334; D23/201, 259, 277, 291, 304, 310, 499; D6/524; D7/304, 306

[56] References Cited

U.S. PATENT DOCUMENTS

| | | | |
|---|---|---|---|
| D. 190,147 | 4/1961 | Fink | D7/304 |
| 1,311,833 | 7/1919 | Mueller | 239/24 |
| 1,947,250 | 2/1934 | Davison et al. | 4/584 |
| 2,113,043 | 3/1937 | Ehrhorn | 4/206 |
| 2,870,456 | 1/1957 | Greensides | 4/559 |
| 3,922,733 | 12/1975 | Lyon et al. | 4/191 |
| 3,927,428 | 12/1975 | Jette et al. | 4/191 |
| 4,111,037 | 9/1978 | Fisher | 4/255 |
| 4,194,252 | 3/1980 | Tsuei | 4/206 |
| 4,300,248 | 11/1981 | Dworkin | 4/658 |
| 4,620,332 | 11/1986 | Laird | 4/609 |
| 4,719,652 | 1/1988 | Diamond | 4/559 |
| 4,796,310 | 1/1989 | Freville et al. | 4/198 |

FOREIGN PATENT DOCUMENTS 3315926 12/1983 Fed. Rep. of Germany ..... 4/300.3

*Primary Examiner*—Henry J. Recla
*Assistant Examiner*—D. Stein-Freer

[57] ABSTRACT

A collector unit for a bathtub which is mounted on the tub end portion below the spout for collecting the water during discharge from the spout and for substantially silencing the water noise and for minimizing overflow from the bathtub. The collector unit includes a back wall, a side wall and a bottom wall forming a water container. The back wall has an aperture for connection to the overflow drain in the end portion of the bathtub. In one embodiment, the collector is joined to the tub end wall by suction cups. In a second, embodiment, the side wall has an aperture and a tube connecting the aperture, and a distributor portion connected to the tube for distributing the water away from the collector toward the tub end and side portions. In the second embodiment, the collector has connector screws, spaced for fitting to a standard overflow opening with screw holes. This collector has a bar having: a handle, an axle and an operator arm, which has a hinged connection to a linkage in the bathtub for opening and closing the drain plug of the bathtub. The collector unit chamber includes suitably sized weirs to further reduce tub overflow problems.

8 Claims, 2 Drawing Sheets

BATHTUB SILENCER AND OVERFLOW PROTECTOR

BACKGROUND OF THE INVENTION

The invention relates a bathtub silencer and overflow protector and particularly to a bathtub silencer and overflow protector having means for connection to an existing bathtub.

The prior art bathtub includes a spout for water discharge, a tub end portion and a tub bottom portion for containing the water and for supporting the spout, a drain with a plug mounted on the tub bottom portion, an overflow opening disposed in the tub end portion, and a shield mounted over the overflow opening and having slots for water flow through the shield.

One problem with the prior art bathtub is that considerable noise is caused by the water falling from the spout onto the tub bottom portion and onto the water contained in the bathtub. Another is that the prior art overflows do not prevent overflowing the tub at full spout discharge rates.

SUMMARY OF THE INVENTION

According to the present invention, a bathtub with a noise silencer and overflow protector structure is provided. This bathtub includes a spout for water discharge mounted on the wall above the tub; the tub includes a tub end and side portion and a tub bottom portion for containing the water and a drain with a plug mounted on the tub bottom portion, an overflow opening disposed in the tub end portion, a shield mounted over the overflow opening and having slots for water flow through the shield, and a noise silencer and overflow protector structure mounted on the tub end portion and disposed under the spout for receiving the water flow from the spout.

By using the noise silencer and water collector and overflow protector structure, it overcomes the problem of the noise caused by the water falling directly onto the water contained in the bathtub, as well as eliminating tub overflow due to inadequate flow rate through standard tub overflow discharge plates relative to spout discharge flow rate

BRIEF DESCRIPTION OF THE DRAWINGS

The above advantages and the subsequent description will be more readily understood by reference to the following drawings.

DESCRIPTION OF THE PREFERRED EMBODIMENT

Figure 1:
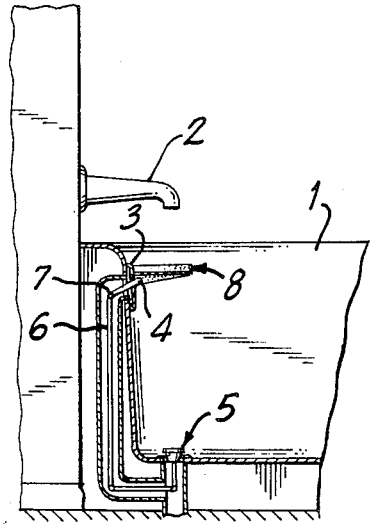
FIG. 1 is a sectional view of a bathtub having a silencer unit according the invention.

In FIG. 1, a bathtub 1, according to the invention, is shown. Bathtub 1 has a spout 2, an overflow opening with a shield 3, a drain plug operator 4, a drain with a plug 5, a linkage 6, a hinged portion or cotter pin 7, and a silencer or collector unit 8.

Spout 2, which is screwed onto a mixing valve body, is mounted on the wall over a tub end portion and protrudes or projects outwardly about three (3) inches, extending over a tub bottom portion. The water discharge or inflow from spout 2 falls onto drain plug 5. Overflow opening and shield 3 are located about three inches below a tub top edge portion. The overflow opening in one embodiment has an inside diameter of about three inches. Shield 3 is a flat plate or casting which has an overflow slots(s) on each side of the shield 3. Shield 3 is hinged to drain plug operator 4, which connects to linkage 6 by cotter pin or hinge portion 7. Operator 4 is about two inches in length in one embodiment.

Figure 2:
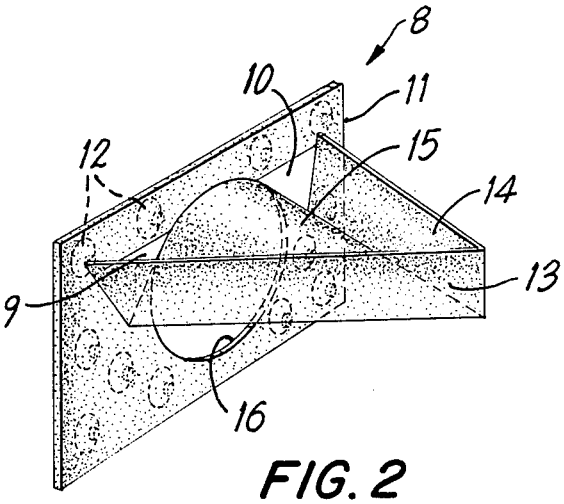
FIG. 2 is a perspective view of the silencer unit of FIG. 1.

In FIG. 2, collector 8 according to the invention is shown. Collector 8 has a back wall 11, which has a left aperture 9 and a right aperture 10. Back wall 11 has a plurality of suction cups 12 which are disposed on the far side of back wall 11 for engaging the tub end portion.

Collector 8 also has a left side wall 13, a right side wall 14, and a bottom wall 15, which has a convex shape. Back wall 11 also has an opening 16 which receives or fits over shield 3.

Silencer 8 accomplishes its sound deadening function in that the convex shaped surface 15, provides a sufficient head for the water falling onto the collector portion defined by walls 13, 14, and 15, so as to quickly distribute the water through apertures 9 and 10 down along the tub end portion. Thus water does not collect directly below the discharging spout 2 but is dispersed readily and out apertures 9 and 10 where it then cascades down along the tub end surface in a gentle flow. Sloping bottom wall 15 towards the back wall 11 will further enhance dispersement of the water.

Collector 8 is made of a rubber material. It can also be made of other similar compliant materials, such as plastic material. Suction cups 12 are made of the same material as the remainder of collector 8. Suction cups 12 may also be made of another material such as a plastic material.

The embodiment of FIG. 2 is particularly suitable where one wishes to utilize the present invention with existing tub configurations.

Figure 3:
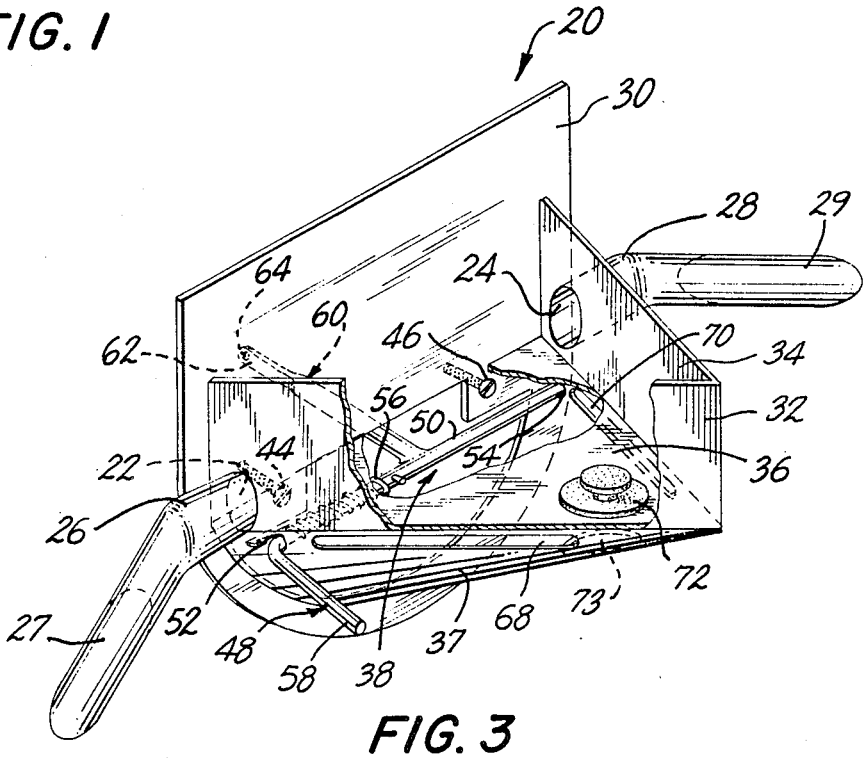
FIG. 3 is a perspective view of another embodiment of the silencer unit including an overflow chamber of FIG. 1.
Figure 6:
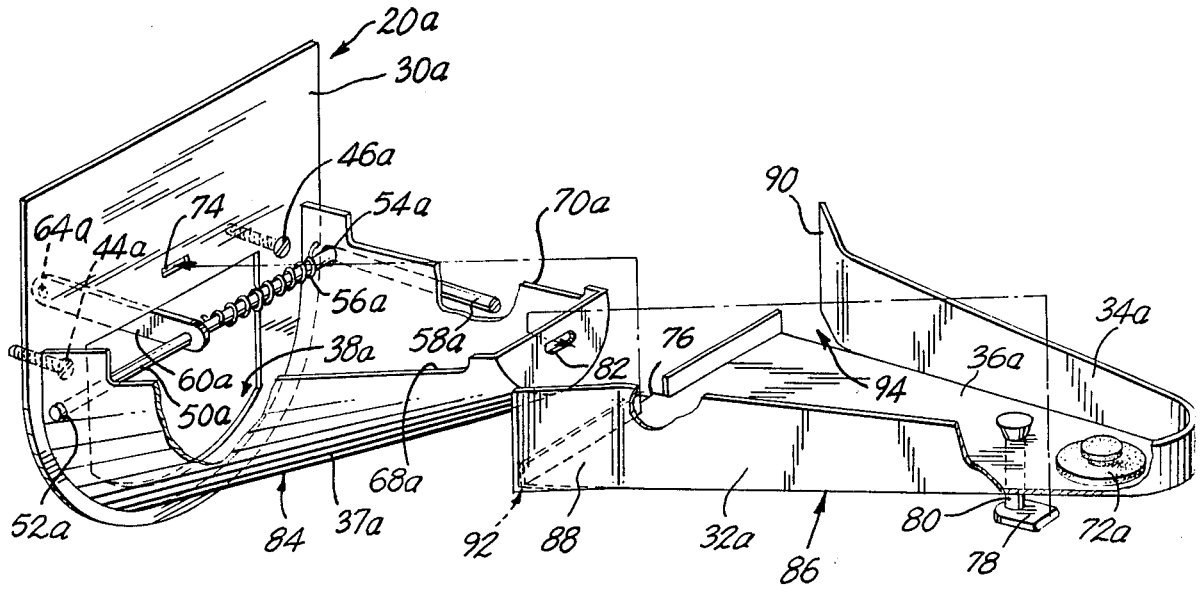
FIG. 6 is an exploded perspective view of a second variation of the embodiment depicted in FIG. 3.

FIG. 3 depicts a second embodiment of the invention. FIG. 6 shows in exploded form, the second embodiment with slight variations which will be identified hereinafter. Parts in the FIG. 6 embodiment performing substantially similar functions to their counterpart in FIG. 3 are labelled with the same reference numeral, followed by the letter "a".

In FIG. 3, a collector 20, which is a second embodiment of the invention, is shown. Collector 20 has a back wall or back plate 30, a left side wall 32, a right side wall 34, and a bottom wall 36. Underneath the bottom wall 36 is the overflow chamber wall 37, which has a concave shape. Left side wall 32 has a left aperture 22 connected to a left tube or tubular nozzle 26, which has a left opening or distributor portion 27.

Right side wall 34 has a right aperture 24, and a right tube or tubular nozzle 28, which has a right distributor portion 29. Back wall 30 has an opening 38, a left screw hole 40, a right screw hole 42, a left screw 44 and a right screw 46.

Collector 20 is composed of a rigid material, such as a metal or hard plastic material. Back wall 30 is attached to the tub end portion by screws 44, 46. Screw holes 40, 42, which are countersunk holes have a bathtub standard spacing of two inches, center to center, and take a three-sixteenths inch screw size. Nozzles 26, 28 are disposed about one quarter inch clear of the tub end wall. Distributors 27, 29, similar to apertures 9 and 10 in the first embodiment, direct the outflows of water toward the tub end and side portions and away from the nozzles 26, 28. Opening 38 in back wall 30 follows the contour of the lower portion of the overflow opening and shield 3.

Figure 5:
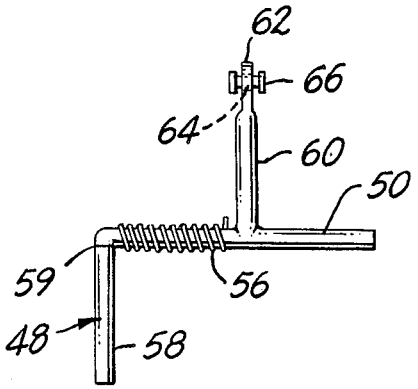

In FIGS. 3 and 5, chamber wall 37 supports a drain plug remote operator or tee-bar 48. Tee-bar 48 has an axle portion 50. Axle 50 is journaled in a left bearing or hole 52 and in a right bearing or hole 54. Bearings 52, 54 are disposed in chamber wall 37. Tee-bar 48 also has a coil spring 56, which has one end portion fixedly connected to axle 50 and which has an opposite end portion fixedly connected to chamber wall 37. Tee-bar 48 also has a lever handle 58. Tee-bar 48 has an arm portion 60, which has a flattened end portion 62 that has a hole 64 that receives the cotter pin 7. Alternately coil spring 56 can be of sufficient length so as to be compressed between arm portion 60 and chamber wall 37 and thus provide the necessary frictional force to permit satisfactory action.

In FIG. 5 linkage 6 has a yoke portion 66, which has a hole that receives the cotter pin 7. Cotter pin 7 is shown in FIG. 1, but it is not shown in FIG. 5.

Chamber wall 37 has a left overflow weir 68, a right overflow weir 70. Bottom wall 36 has a plugged opening 72. Coaxially aligned with opening 72, in the chamber wall 37, is a second opening 73.

Tee-bar 48 operates linkage 6 to move drain plug 5 from an open to a closed position and back to an open position as required. Lever 58 has a connection 59, such as a welded connection or threaded connection to axle 50 for ease of assembly and installation. Spring 56 provides a friction force to counteract the downward force of linkage 6, due to the weight of linkage 6 and drain plug 5. Weirs 68, 70 are long and narrow weirs to allow a high rate of discharge at a low head. As a result, for a given bathtub size, there is less chance of oversplash when a body is submerged suddenly in the bathtub full of water. Plugged opening 72 and opening 73 are aligned along a vertical axis with the outlet end of spout 2, so that flow of water can bypass collector 20, when the plug of opening 72 is removed, when desired as when filling a water pail.

Although not easily discernible from the drawing, bottom wall 36 is pitched downward and/or shaped convexly, similar to bottom wall 15, from plugged opening 72 towards apertures 22 and 24. The pitch or convex shape, again, provides a sufficient head so as to quickly distribute the water towards and through the apertures 22 and 24.

FIG. 6 depicts the embodiment of FIG. 3 in an exploded view to show how the unit can be practically fabricated. Alignment hole 74 receives tab 76; and after the unit is assembled, cam member 78, rotatably mounted to wall **36*a* on shaft 80 is turned to engage opening 82, locking sub-assemblies 84 and 86 together to form the single unit. In FIG. 6 the drain plug remote operator means is shown inverted from that depicted in FIG. 3, but, of course, operates essentially in the same manner. Further in FIG. 6, sidewalls 32*a* and 34*a* are formed such that the end portions thereof 88 and 90, are not coplanar with the wall creating, in effect, aperture openings 92 and 94 at the juncture of the sidewalls and bottom wall 36*a* with the back wall 30*a*. These openings, 92 and 94**, permit the discharge of water from the collector.

Certain advantages of the invention are indicated hereafter.

1. Silencer 8 and silencer 20 overcomes the problem of noise, which is caused by water falling directly from spout 2 onto the tub bottom portion and onto the water contained in the bathtub.

2. Silencer 20 minimizes the danger of splashing and overflow of the bathtub, when the water in the bathtub is near the top edge portion of the bathtub.

3. Collector 8, 20, which is in the path of flow of water discharge, breaks the fall of the discharge stream and redirects the stream as it enters the tub, thereby substantially silencing the noise of the stream and distributing the water within the bathtub.

While the invention has been described in its preferred embodiments, it is to be understood that the words which have been used are words of description, rather than limitation and that changes may be made within the purview of the appended claims without departing from the true scope and spirit of the invention in its broader aspects.

Figure 4:
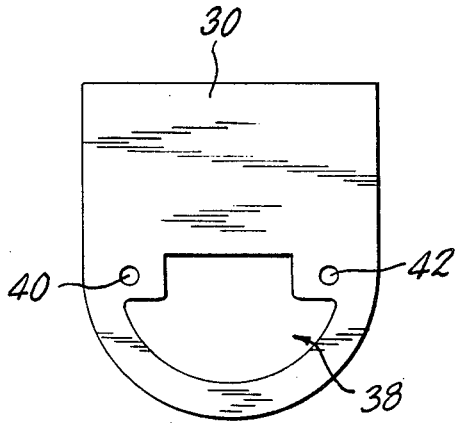
FIG. 4 is a section view as taken along an inner face of a backwall portion of the silencer unit of FIG. 3; and, FIG. 5 is a plan section view of an operator portion of the silencer unit of FIG. 3.

For example, in FIG. 2, suction cup 12 can be replaced by a strip of material with an adhesive on each side of the strip. In FIG. 4, screw holes 40, 42 and screws 44, 46 can be replaced by a bent portion of backplate 30 which can slip behind a shield or cover of overflow opening 3. In FIG. 4, backplate 30 can also have separate clips on its far side which can slip over the heads of the standard shield or cover screws. In FIG. 2, FIG. 4, or FIG. 6, the shield for overflow opening 3 can be an integral portion of collector 8 and 20, and can be disposed in the location of opening 16 or 38.

I claim:

1. A collector and silencer unit for use in a bathtub having an overflow, for intercepting the water discharged from a spout, disposed above said unit in its free fall and redirecting it towards the back wall of the bathtub wherein said unit comprises:

a bottom wall, side walls and a back wall defining an open top receptacle, said bottom wall slanting downwardly toward said back wall, said back wall including means for mounting on a bathtub wall below a spout, flowpath means adjacent the intersection of said back wall, bottom wall, and side walls for directing the flow of water along the bathtub wall, whereby water from said spout is collected and silenced by being directed along the inside surface of a bathtub.

2. The collector unit of claim 1, wherein said mounting means comprises suction cups for ease of placement and removal.

3. The collector unit of claim 1, wherein said backwall has means to fit under the attachment screws of a standard overflow shield for support.

4. The collector unit of claim 1, wherein said flow path means are slotted tubes connected to said side walls.

5. The collector unit of claim 1, further comprising an overflow chamber mounted beneath said bottom wall, adapted to be connected to the overflow of the bathtub, said chamber having elongated, substantially horizontal weirs of sufficient length and geometry to assure full containment of the water within the tub at full discharge of a standard faucet.

6. The collector unit of claim 1, wherein said overflow chamber has an operator arm for a conventional remote operated tub drain plug linkage, said arm bringing the operating lever outside the confines of said chamber on either side of said chamber through bearings in the walls of the chamber.

7. The collector unit of claim 6 wherein said bottom wall has a plugged opening aligned in the vertical direction with the outlet opening of the spout, whereby water can bypass the collector if the plug is removed, when required.

8. The collector unit of claim 1 wherein said bottom wall is convex shaped downward from the point of contact with water from the spout, with a slope towards the back wall of the tub.

* * * * *